US006434873B1

(12) United States Patent
Pierce

(10) Patent No.: US 6,434,873 B1
(45) Date of Patent: Aug. 20, 2002

(54) ORNAMENTAL DISPLAY FOR ACHIEVEMENT AWARDS

(76) Inventor: Ian Stewart Pierce, 150 First Street, P.O. Box 21008, Orangeville, Ontario (CA), L9W 4S7

( * ) Notice: Subject to any disclaimer, the term of this patent is extended or adjusted under 35 U.S.C. 154(b) by 0 days.

(21) Appl. No.: 09/443,127

(22) Filed: Nov. 18, 1999

(51) Int. Cl.[7] ..... A47G 1/06
(52) U.S. Cl. ..... 40/781
(58) Field of Search ..... 40/661, 124.5, 40/737, 771, 800; 428/542.2, 542.6, 542.4

(56) References Cited

U.S. PATENT DOCUMENTS 1,946,033 A * 2/1934 Potter ..... 40/124.5
3,312,197 A * 4/1967 Smith ..... 40/661
4,125,655 A 11/1978 Kanzelberger
4,259,388 A 3/1981 Reed
4,645,556 A * 2/1987 Waugh et al. ..... 156/242
4,737,225 A * 4/1988 Waugh et al. ..... 156/242
4,991,328 A * 2/1991 Rousseau et al. ..... 40/155
5,415,902 A 5/1995 Stryker, Jr.
5,584,135 A 12/1996 Hosker
5,834,073 A 11/1998 Greenblat et al.

* cited by examiner

*Primary Examiner*—Cassandra H. Davis
(74) *Attorney, Agent, or Firm*—Marks & Clerk

(57) ABSTRACT

An ornamental display for use most typically as an achievement award is disclosed. The ornamental display comprises a front panel having peripheral edges, a back panel having peripheral edges, an insert, a cavity, and a fastener. The insert has at least a front face which gives the visual appearance of being three dimensional, and is chosen from the group consisting of embossed paper, embossed cardboard, embossed plastic, a stamped metal sheet, and a hologram. The front panel, insert, and back panel are held together by the fastener. The cavity is formed when the front panel and the back panel are placed together such that at least the peripheral edges of each of the panels are in an opposed relationship and are in contact each with the other. When the ornamental display is assembled, the insert is permanently displayed inside the cavity.

19 Claims, 3 Drawing Sheets

ORNAMENTAL DISPLAY FOR ACHIEVEMENT AWARDS

FIELD OF THE INVENTION

This invention relates to the field of achievement awards and in its most common form, trophies, plaques, and medallions. More particularly, the invention is directed towards its off the shelf nature of construction while also being relatively inexpensive and easily adapted for a multitude of different activities and purposes.

BACKGROUND OF THE INVENTION

Ornamental displays such as a trophy, plaque, or medallion are very popular types of achievement awards given to individuals or teams to reward a performance well done. Performance may be in relation to sporting activities, work projects, years of service, etc. These awards are typically inscribed such that there is a commemorative tablet mounted thereon. Trophies typically consist of a base with a gold or silver coloured figure sitting atop a column, where the figure represents a specific activity. Plaques generally have a solid wood or particle board back panel with a picture or a figure and a commemorative tablet mounted thereon. Medallions are typically circular metal plates which may have a design on the front face and engraving on the rear face. The construction of such items listed above typically involves the casting of a mould for the figure portion, cutting extruded sheets of material for trophy columns, and forming a base. The moulding of a figure is both timely and costly. An image such as a basketball player or a soccer player may have an existing mould and will cut down some of the assembly time. However, if the customer wants a unique item such as an award for a debating tournament, shuffleboard, or another activity that is uncommon, before the figures can even be poured, the mould itself must be constructed. The entire process requires that the customer place orders far in advance. It is a key feature of the present invention to facilitate ease of assembly and provide an improved cost-effective ornamental display.

An ornamental display in keeping with the present invention avoids the previous limitations of the prior art. An ornamental display of the present invention comprises front and back panels, where each panel has peripheral edges, an insert, a cavity, and fastening means. The insert has at least a front face which gives the visual appearance of being three dimensional. The cavity is formed when the front panel and the back panel are placed together such that the peripheral edges of each of the panels are in an opposed relationship and are in contact each with the other. The fastening means hold together the front panel, the insert, and the back panel and when the ornamental display is assembled, the insert is permanently displayed inside the cavity. Of the front and back panels, at least one is translucent such that the insert is visible through at least one panel. Items of merchandise particularly suited for construction in the form of an ornamental display, in keeping with the present invention, include trophies, plaques, medallions, key chains, pins, and badges.

DESCRIPTION OF THE PRIOR ART

U.S. Pat. No. 4,125,655 issued to KANZELBERGER teaches a low cost decorative award plaque which uses a plastic laminant article capable of being hot stamped with desired lettering and/or designs. The plaque is made by the process of repeatedly imprinting with different colours and surface effects. The term "lettering" defines any form of letter and/or numeral design, logo-type trade mark, or the like, which may be printed, embossed, or debossed. A plastic layer may be cemented to the plaque surface by one or more hot stamping foils. Repeated stamping may give the plaque a more attractive appearance. In addition, repeated stamping also allows the incorporation of more than one foil colour which may enhance the degree of contrast between lettering the remaining plaque surface.

U.S. Pat. No. 4,259,388 issued to REED patent teaches a medallion-like article for either decorative or identification purposes. The medallion is formed by applying a curable polymer to the medallion surface in a sufficient quantity so as to form a convex upper surface, and then irradiating the polymer to effect its cure. This patent focuses on the curing process, and attempts to provide an inexpensive method to adhesively bond surfaces to the medallion objects. A further object of this patent is to manufacture medallions that may be inexpensively and attractively embossed into "pleasing indicia" such that the strength of the material of manufacture will not deform away from the embossed pattern.

STRYKER U.S. Pat. No. 5,415,902 teaches a display plaque comprising an indicia visible through a transparent facing material, an opaque facing material, and a back plate.

The back plate supports each of the facing materials together. The back plate and the two front facing plates are secured together by means of a transparent bonding agent. The indicia may be imprinted onto the side of the transparent member which is facing the back plate or may be imprinted on the side of the back plate that is facing the transparent member. The surface in which the indicia is imprinted is bonded to a second surface material.

U.S. Pat. No. 5,584,135 issued to HOSKER teaches an award plaque including a picture display assembly. The award plaque comprises a top panel, a back panel, two additional layers and a frame. The top panel may have a brass plate mounted thereon, and may also have hot foil stamping on its surface. Also formed through the top panel is a relatively large rectangular opening through which a photographic print may be inserted. Flush with the top panel is a backing panel. The back panel is urged against the underside of the top panel by a resilient layer constructed from relatively stiff material. This resilient layer is slightly thicker than the top and backing panels.

Finally, there is a bottom member constructed from heavy inflexible material located flush with the resilient layer. A "U"-shaped cross-sectional peripheral frame holds the top panel and the associated under panels in a sandwiched relationship.

GREENBLAT and BANMAN U.S. Pat. No. 5,834,073 teaches an achievement award comprising a novelty which is substantially transparent, injection molded acrylic plaque, and a supporting base. The transparent plaque has a fossil-like decorative design or image which appears to be embedded in the central portion of the plaque. The central portion includes a front face and a rear face wherein the fossil-like image is formed in the rear face. At the base of the central portion is a three-dimensional insert which is also injection molded. This insert connects the central portion to the base. The insert portion of the plaque is adapted for fitment in the base portion. The central portion and the base are then sealably interconnected by suitable means.

SUMMARY OF THE INVENTION

In accordance with one aspect of the present invention, there is provided an ornamental display. The display comprises a front and back panels, each having a peripheral edge, an insert, a cavity, and fastening means. The cavity is formed when the front and back panels are placed together such that at least the peripheral edges of each panel are in an opposed relationship and are in contact each with one another. When assembled, the insert is permanently displayed inside the cavity and the front panel, back panel, and insert are held together by fastening means.

The insert has at least a front face which gives the visual appearance of being three dimensional. The insert may be constructed from embossed paper, embossed cardboard, embossed plastic, a stamped metal sheet, a hologram, and combinations thereof, and forms a rigid structure for mounting inside the cavity of the ornamental display.

The greatest depth of the cavity is significantly smaller than any of the dimensions of height or width of the cavity. There is a major plane passing through the cavity where portions of the cavity are both in front of and behind the major plane. The portions are defined by the front and back panels respectively.

At least one of the front and back panels is translucent such that the insert is visible through at least one panel.

In a particular embodiment the ornamental display is a trophy. The insert, in this instance, is double-sided. The insert has front and back faces where both the front and back faces of the insert are different from one another. Each of the front and back panels of the ornamental display is translucent such that the front face of the insert is visible through the front panel and the back face of the insert is visible through the back panel.

One of the insert, front panel, and back panel may be hot foil stamped.

One of the front panel and the back panel may be faceted. A portion of the cavity may be faceted to cause a reflection of light in at least one plane other than a plane perpendicular to the major plane of the cavity.

The double-sided insert, when formed, may be a single folded element. The front face and the back face of the insert lie in substantially the same plane when the insert is unfolded. When folded, the front face and the back face of the insert lie in substantially the same plane. When folded, the front and back faces of the insert are flush and in contact one with the other such that the 3-dimensional aspects of the insert are visible through the front and back panels respectively.

At least one of the front and back panels may be a lens such that the 3-dimensionality of the double sided insert is enhanced.

In another particular embodiment, the ornamental display is a plaque. The insert, in this instance, has a single front face. The front panel is translucent and at least one of the insert, front panel, and back panel may be hot foil stamped. The plaque may have a base such that it is free-standing. The front panel of the ornamental display may be faceted. A portion of the cavity may be faceted to cause the reflection of light in at least one plane other than a plane perpendicular to the major plane of the cavity.

In a third particular embodiment, the ornamental display is a medallion. The insert, in this instance, has a single front face. The front panel is translucent, the back panel is an engraveable metallic slug. At least one of the insert, front panel, and back panel may be hot foil stamped. The front panel of the ornamental display may be faceted. A portion of the cavity may be faceted to cause the reflection of light in at least one plane other than a plane perpendicular to the major plane of the cavity.

The fastening means which hold each of the front panel, the back panel, and the insert together may be selected from adhesive, ultrasonic welding, double-sided tape, snap fasteners, tongue and groove fasteners, force-fitted attachment of co-operative profiles, and combinations thereof. The ornamental display, when assembled forms a rigid structure that is commonly free standing, or may be mounted on a wall surface or worn as a medallion. Other purposes to which the ornamental display of the present invention may be put include key chains, pins, and badges.

BRIEF DESCRIPTION OF THE DRAWINGS

The novel features which are believed to be characteristic of the present invention, as to its structure, organization, use and method of operation, together with further objectives and advantages thereof, will be better understood from the following drawings in which a presently preferred embodiment of the invention will now be illustrated by way of example. It is expressly understood, however, that the drawings are for the purpose of illustration and description only and are not intended as a definition of the limits of the invention. Embodiments of this invention will now be described by way of example in association with the accompanying drawings in which.

DETAILED DESCRIPTION OF THE PREFERRED EMBODIMENTS

Figure 1:
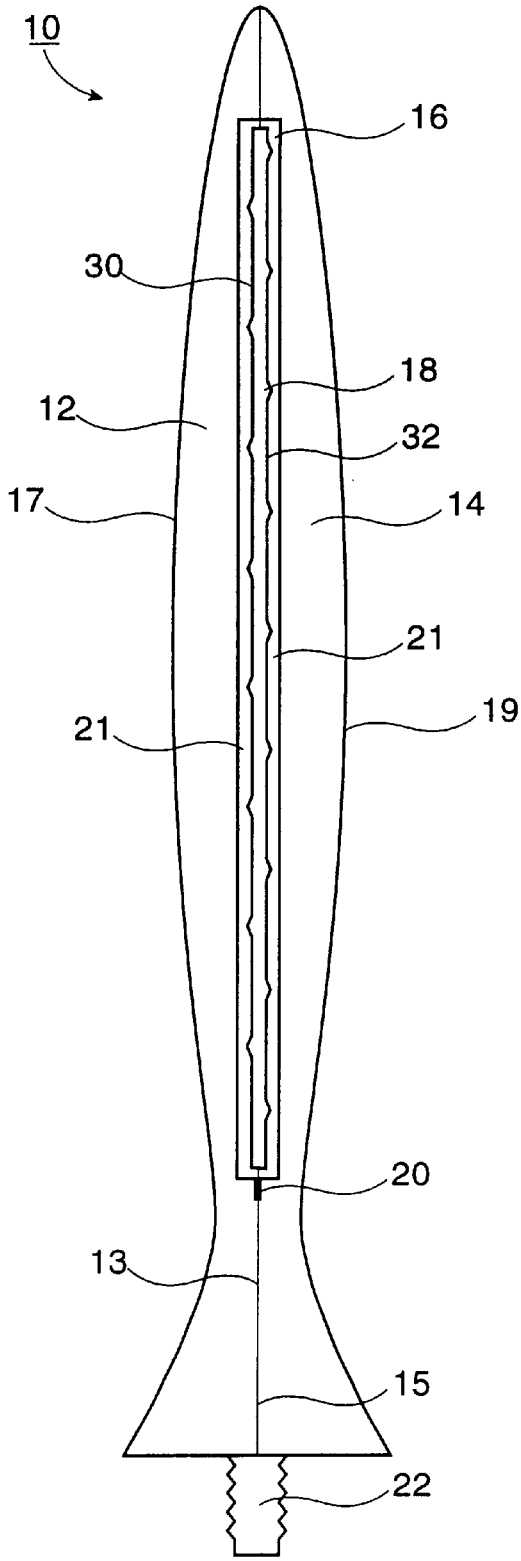
FIG. 1 is a side view of the configuration of a first embodiment of the ornamental display of the present invention.

Referring now to the drawings, there is illustrated an ornamental display generally designated by reference numeral 10. The ornamental display comprises a front panel 12 having peripheral edges 13, a back panel 14 having peripheral edges 15, an insert 18, a cavity 16, and fastening means 20. The cavity 16 is formed when the peripheral edges 13, 15 of the front and back panels 12, 14 are placed together such that at least the peripheral edges 13, 15 of each of the respective panels are in an opposed relationship and are in contact each with the other. When assembled, the insert 18 is permanently displayed inside the cavity 16 and the front panel 12, the back panel 14, and the insert 18, are held together by fastening means 20. It is very evident from FIGS. 1 and 4 that there is a space, indicated at 21, which is defined by the cavity 16, and which surrounds at least one of the front face 30 or rear face 32 of the insert 18. Thus, the insert 18 is space into the space 21 within the cavity 16.

The front panel 12, and back panel 14, have outer faces 17, 19, respectively.

Figure 5:
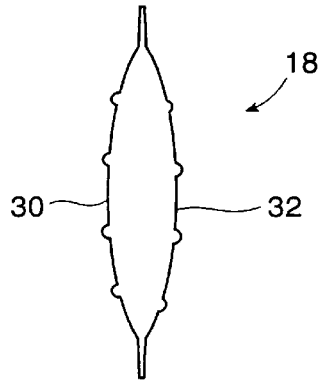
FIG. 5 is a side view of the configuration of a double-sided insert present in the first embodiment of the ornamental display of the present invention.

The insert 18 has at least a front face 30 which gives the visual appearance of being three-dimensional In a particular embodiment, the insert 18 has both a front face 30 and a rear face 32, as shown in FIG. 5.

The insert 18 may be constructed from embossed paper, embossed cardboard, embossed plastic, a stamped metal sheet, a hologram, and combinations thereof. The insert 18 forms a rigid structure that is mounted and permanently displayed inside the cavity 16 when the ornamental display 10 is assembled.

The cavity 16, at its greatest depth, is significantly smaller than any other dimensions of height or width of the cavity 16. There is a major plane passing through the cavity 16 where portions of the cavity 16 are both in front and behind the major plane. These portions are defined by the front panel 12 and the back panel 14 respectively.

The ornamental display 10 has at least one panel selected from the front panel 12 and the back panel 14 that is translucent, such that the insert 18 is visible through that at least one panel.

Figure 2:
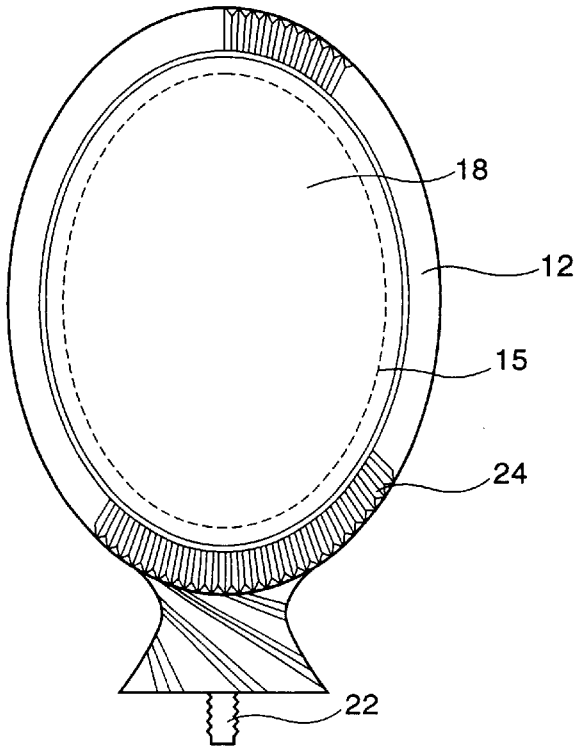
FIG. 2 is a front view of the configuration of a first embodiment of the ornamental display of the present invention.

In a particular embodiment, the ornamental display 10 is a trophy as depicted in FIG. 2. The insert 18 is double sided and has a front face 30 and a back face 32, which are different one from the other. Each of the front panel 12 and the back panel 14 of the ornamental display 10 are translucent such that the front face 30 of the insert 18 is visible through the front panel 12, and the back face 32 of the insert 18 is visible through the back panel 14.

In this instance, one of the insert 18, the front panel 12, and the back panel 14, may be hot foil stamped.

The ornamental display 10 is affixed to a base by securing means 22 such that the trophy is free-standing. The front panel 12 and the back panel 14 may be faceted 24. A portion of the cavity 16 may be faceted to cause a reflection of light in at least one plane other than a plane perpendicular to the major plane of the cavity 16.

The double sided insert 18 having both a front face 30 and a back face 32, when formed, may be as a single folded element. The front face 30 and the back face 32 of the insert 18 lie in substantially the same plane when the insert is unfolded. When folded, the front face 30 and the back face 32 of the insert 18 are flush and in contact one with the other, and the three-dimensional aspects of the insert 18 are visible through the front and back panels 12, 14 respectively. At least one of the front panel 12 and the back panel 14 may be formed as a lens, such that the 3-dimensionality of the double-sided insert 18 is enhanced.

Figure 3:
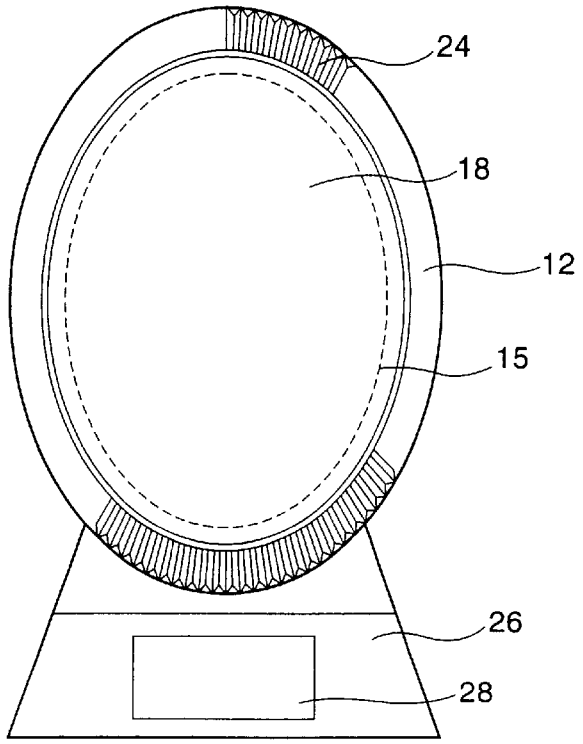
FIG. 3 is a front view of the configuration of a second embodiment of the ornamental display of the present invention.
Figure 6:
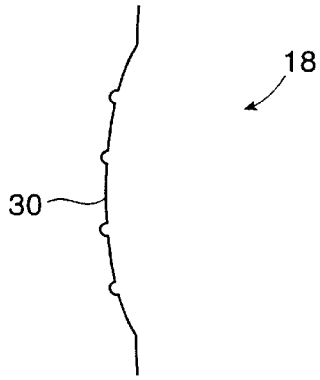
FIG. 6 is a side view of the configuration of a single-sided insert present in the second and third embodiments of the ornamental display of the present invention.

In another particular embodiment shown in FIG. 3, the ornamental display 10 is a plaque. The insert 18 is single sided (FIG. 6) and has a single front face 30. The front panel 12 of the ornamental display 10 is translucent such that the front face 30 of the insert 18 is visible through the front panel 12. In this instance, one of the insert 18, the front panel 12, and the back panel 14, may be hot foil stamped.

The plaque may have a base 26 such that it is free standing. Typically, a small engraved plate 28 is placed on the base 26.

The front panel 12 of the ornamental display 10 may be faceted 24. A portion of the cavity 16 may be faceted to cause a reflection of light in at least one plane other than a plane perpendicular to the major plane of the cavity 16.

Figure 4:
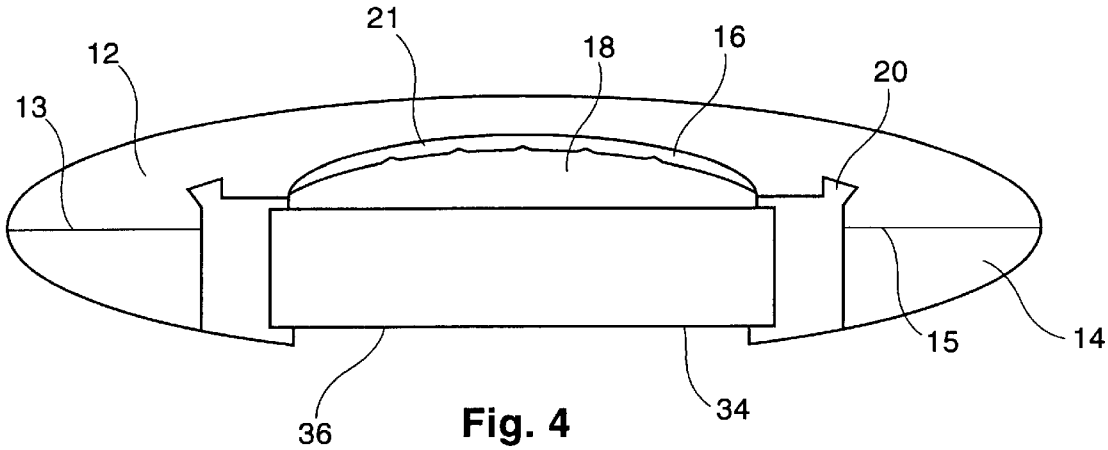
FIG. 4 is a side view of the configuration of a third embodiment of the ornamental display of the present invention.

In a third particular embodiment shown in FIG. 4, the ornamental display 10 is a medallion. The insert 18 is single sided (FIG. 6) and has a single front face 30. The front panel 12 of the ornamental display 10 is translucent such that the front face 30 of the insert 18 is visible through the front panel 12. The back panel 14 has an engraveable metallic plate 34 captured therein, which has a face 36 into which an inscription may be engraved. Typically, the plate 34 may be zinc, with a gold or bronze coloured face 36, so that when the face 36 is engraved the white zinc is revealed to form the inscription. At least one of the insert 18, the front panel 12, and the back panel 14, may be hot foil stamped.

The front panel 12 of the ornamental display 10 may be faceted 24. A portion of the cavity 16 may be faceted to cause a reflection of light in at least one plane other than that plane perpendicular to the major plane of the cavity 16.

The fastening means 20 to hold each of the front panel 12, back panel 14, and the insert 18 together, may be selected from adhesive, ultrasonic welding, double-sided tape, snap fasteners, tongue and groove fasteners, force-fitted attachment of co-operating profiles, and combinations thereof. The ornamental display 10, when assembled, forms a rigid structure that is commonly free standing or mounted on a wall surface or hung as a medallion.

Other modifications and alterations may be used in the design and manufacture of the apparatus of the present invention without departing from the spirit and scope of the accompanying claims.

Throughout this specification and the claims which follow, unless the context requires otherwise, the word "comprise", and variations such as "comprises" or "comprising", will be understood to imply the inclusion of a stated integer or step or group of integers or steps but not to the exclusion of any other integer or step or group of integers or steps.

Moreover, the word "substantially" when used with an adjective or adverb is intended to enhance the scope of the particular characteristic; e.g., substantially planar is intended to mean planar, nearly planar and/or exhibiting characteristics associated with a planar element.

What is claimed is:

1. An ornamental display comprising:

a front panel having peripheral edges;

a back panel having peripheral edges;

an insert having peripheral edges and at least a front face, which insert gives the visual appearance of being three dimensional, where the insert is chosen from the group consisting of embossed paper, embossed cardboard, embossed plastic, a stamped metal sheet, a hologram, and combinations thereof;

a cavity which defines a space; and fastening means;

wherein said from panel, said insert, and said back panel are held together by said fastening means;

wherein said cavity is formed when said front panel and said back panel are placed together such that at least said peripheral edges of each of said panels are in an opposed relationship and are in contact each with the other so as to define said space in the region of said cavity between said front panel and said back panel;

wherein said insert is placed into said space defined by said cavity, and is secured therein at least at portions of said peripheral edges thereof; and wherein at least one of said front panel and said back panel is translucent such that said insert in said space defined by said cavity is visible through at least one of said front panel and said back panel respectively;

whereby, when said ornamental display is assembled, said insert is displayed inside said cavity.

2. The ornamental display of claim 1, wherein the greatest depth of said cavity is significantly smaller than any of the dimensions of height or width of said cavity; and wherein said cavity has a major plane, and portions of said cavity are in front of or behind said major plane; and wherein those portions are defined by said front and back panels respectively.

3. The ornamental display of claim 1, wherein at least one of said front panel and said back panel is a lens such that said lens enhances the 3-dimensionality of said insert located between said front panel and said back panel.

4. The ornamental display of claim 1, wherein said fastening means is chosen from the group consisting of adhesive, ultrasonic welding, double-sided tape, snap fasteners, tongue and groove fasteners, force-fitted attachment of co-operating profiles, and combinations thereof.

5. The ornamental display of claim 1, wherein said insert has front and back faces and said front face and said back face of said insert are different from one another.

6. An ornamental display which is adapted for use as a trophy comprising:

a front panel having peripheral edges;

a back panel having peripheral edges;

an insert having peripheral edges and front and back faces, which insert gives the visual appearance of being three dimensional, where the insert is chosen from the group consisting of embossed paper, embossed cardboard, embossed plastic, a stamped metal sheet, a hologram, and combinations thereof;

a cavity which defines a space;

fastening means; and a base;

wherein said front panel, said insert, and said back panel are held together by said fastening means;

wherein said cavity is formed when said front panel and said back panel are placed together such that at least said peripheral edges of each of said panels are in an opposed relationship and are in contact each with the other so as to define said space in the region of said cavity between said front panel and said back panel;

wherein said insert is placed into said space defined by said cavity, and is secured therein at least at portions of said peripheral edges thereof;

wherein said front face and said back face are different one from the other; and wherein both said front and back panels of said trophy are translucent such that said front face of said insert in said space defined by said cavity is visible through said front panel, and said back face of said insert is visible through said back panel;

whereby, when said trophy is assembled, said insert is displayed inside said cavity.

7. The ornamental display of claim 6, wherein at least one of said front panel and said back panel is faceted.

8. The ornamental display of claim 6, wherein a portion of said cavity is faceted so as to cause a reflection of light in at least one plane other than perpendicular to said major plane of said cavity.

9. The ornamental display of claim 6, wherein said insert may be formed as a single folded element, such that said front face and said back face of said insert lie in substantially the same plane when unfolded; wherein when said insert is folded, said front face and said back face lie in substantially the same plane, 180 degrees from one another, and said front face and said back face are in an opposed relationship and are in contact each with the other such that the three dimensional aspects of each of said front face and said back face is visible through said front panel and said back panel, respectively.

10. The ornamental display of claim 6, wherein at least one of said insert, said front panel, and said back panel is hot foil stamped.

11. An ornamental display which is adapted for use as a plaque, comprising:

a front panel having peripheral edges;

a back panel having peripheral edges;

an insert having peripheral edges and a single front face, which insert gives the visual appearance of being three dimensional, where the insert is chosen from the group consisting of embossed paper, embossed cardboard, embossed plastic, a stamped metal sheet, a hologram, and combinations thereof;

a cavity which defines a space; and fastening means;

wherein said front panel, said insert, and said back panel are held together by said fastening means;

wherein said cavity is formed when said front panel and said back panel are placed together such that at least said peripheral edges of each of said panels are in an opposed relationship and are in contact each with the other so as to define said space in the region of said cavity between said front panel and said back panel;

wherein said insert is placed into said space defined by said cavity, and is secured therein at least at portions of said peripheral edges thereof; and wherein said front panel of said plaque is translucent, said back panel of said plaque is opaque;

whereby, when said plaque is assembled, said insert is displayed inside said cavity.

12. The ornamental display of claim 11, wherein said plaque has a base such that it is free-standing.

13. The ornamental display of claim 11, wherein said front panel is faceted.

14. The ornamental display of claim 11, wherein a portion of said cavity is faceted so as to cause a reflection of light in at least one plane other than perpendicular to said major plane of said cavity.

15. The ornamental display of claim 11, wherein at least one of said insert, said front panel, and said back panel is hot foil stamped.

16. An ornamental display which is adapted for use as a medallion, comprising:

a front panel having peripheral edges;

a back panel having peripheral edges;

an insert having peripheral edges and a single front face, which insert gives the visual appearance of being three dimensional, where the insert is chosen from the group consisting of embossed paper, embossed cardboard, embossed plastic, a stamped metal sheet, a hologram, and combinations thereof;

a cavity which defines a space; and fastening means;

wherein said front panel, said insert, and said back panel are held together by said fastening means;

wherein said cavity is formed when said front panel and said back panel are placed together such that at least said peripheral edges of each of said panels are in an opposed relationship and are in contact each with the other so as to define said space in the region of said cavity between said front panel and said back panel;

wherein said insert is placed into said space defined by said cavity, and is secured therein at least at portions of said peripheral edges thereof; and wherein said front panel of said medallion is translucent, said back panel of said medallion comprises an engraveable metallic plate captured therein;

whereby, when said medallion is assembled, said insert is displayed inside said cavity.

17. The ornamental display of claim 16, wherein said front panel is faceted.

18. The ornamental display of claim 16, wherein a portion of said cavity is faceted so as to cause a reflection of light in at least one plane other than perpendicular to said major plane of said cavity.

19. The ornamental display of claim 16, wherein at least one of said insert, said front panel, and said back panel is hot foil stamped.

* * * * *